US006319458B1

(12) United States Patent
Jung et al.

(10) Patent No.: US 6,319,458 B1
(45) Date of Patent: Nov. 20, 2001

(54) PULVERIZED COAL INJECTING APPARATUS

(75) Inventors: Jin Kyung Jung; Sang Suk Yuk; Bong Rae Cho; Gap Ryeol Kim; Youn Sueg Choi, all of Cheonram-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/509,711

(22) PCT Filed: Sep. 8, 1999

(86) PCT No.: PCT/KR99/00440

§ 371 Date: Mar. 31, 2000

§ 102(e) Date: Mar. 31, 2000

(87) PCT Pub. No.: WO00/09763

PCT Pub. Date: Feb. 24, 2000

(30) Foreign Application Priority Data

Aug. 13, 1998 (KR) ..... 98-15221
Jul. 19, 1999 (KR) ..... 99-29067

(51) Int. Cl.[7] ..... C21B 7/16
(52) U.S. Cl. ..... 266/266; 266/268
(58) Field of Search ..... 266/47, 265, 266, 266/268

(56) References Cited

U.S. PATENT DOCUMENTS 2,454,892 * 11/1948 Sprow ..... 266/266
4,434,976 * 3/1984 Murkami et al. ..... 266/268
5,333,840 8/1994 Sköld ..... 266/47

OTHER PUBLICATIONS

Maki, Akira et al., "High Rate Coal Injection of 218 kg/t at Fukuyama No. 4 Blast Furnace," *ISIJ International*, vol. 36 (1996), No. 6, pp. 650–657, Dec. 1996.
Takeda, Kanji et al., "Integrated Mathematical Model of Pulverised Coal Combustion in a Blast Furnace," *ISIJ International*, vol. 37 (1997), No. 5, pp. 432–440, Dec. 1997.
Béér, J.M. et al., "Combustion Aerodynamics," Chapter 5, "Swirling Flows," pp. 100–145, *Applied Science Publishers Ltd*Dec. 1957.
Peters, K.H. et al., "Effect of High Levels of Coal Injection on Blast Furnace Operation," *2nd European Ironmaking Congress*, pp. 247–262, No Date.
Wikström, J.O. et al., "SSAB/MEFOS Oxy–Coal System — 3 Years of Industrial Experience," 1996 Ironmaking Conference Proceedings, pp. 61–66, Dec. 1996.

* cited by examiner

*Primary Examiner*—Scott Kastler
(74) *Attorney, Agent, or Firm*—Webb Ziesenheim Logsdon Orkin & Hanson, P.C.

(57) ABSTRACT

A pulverized coal injecting apparatus includes a cylindrical inner pipe for feeding pulverized coal into a tuyere of a blast furnace. A cylindrical outer pipe coaxially surrounds the inner pipe. A spiral swirler is formed on the surface of the inner pipe and the pulverized coal is supplied through the inner pipe, while a combustible fluid is supplied through a space defined between the outer and inner pipes. The pulverized coal injecting apparatus further includes a plurality of dimples formed on a surface of a leading end portion of the inner pipe for reducing fluid flow resistance so as to improve the mixing of the pulverized coal with the combustible fluid. The fluid flow becomes efficient so as to improve the combustion efficiency of the pulverized coal. Thus, the oxygen enrichment cost and fuel costs are reduced.

14 Claims, 10 Drawing Sheets

PRIOR ART

PRIOR ART

FIG. 7
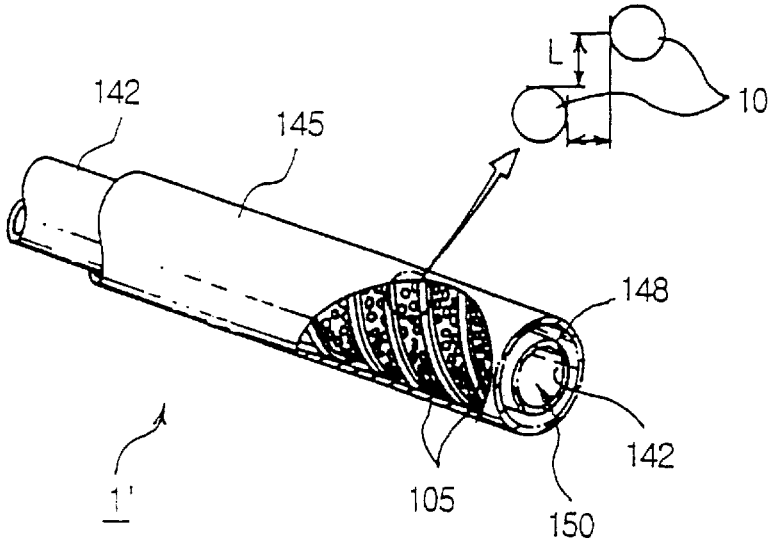
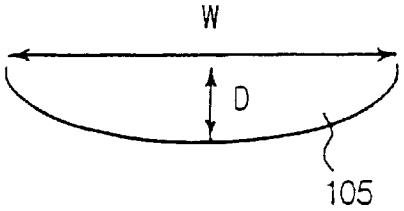
FIG. 8(a)
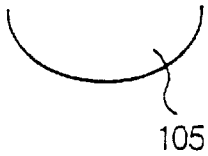
FIG. 8(b)
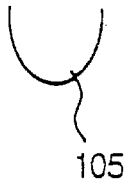
FIG. 8(c)
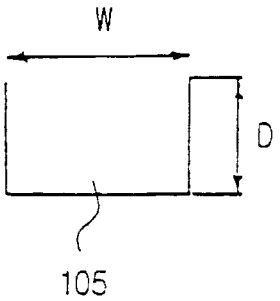
FIG. 8(d)
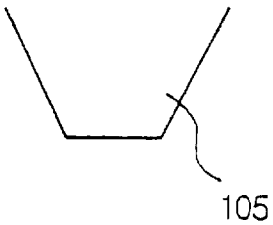
FIG. 8(e)

PULVERIZED COAL INJECTING APPARATUS

This application is a 371 filing of PCT/KR99/00440 filed on Sep. 8, 1999.

FIELD OF THE INVENTION

The present invention relates to a pulverized coal injecting apparatus in which oxygen is used to improve the combustion of pulverized coal in a blast furnace using the pulverized coal instead of the expensive coal in a pig iron manufacturing process. Particularly the present invention relates to a pulverized coal injecting apparatus in which dimples are formed on the surface if an inner pipe to improve the combustion of the pulverized coal.

BACKGROUND OF THE INVENTION

Generally in a pig iron manufacturing process of a blast furnace, as shown in FIG. 1(*a*), iron ore as a raw material and coke as a fuel are fed through the top of the furnace, while hot air is fed through a tuyere which is formed on a lower portion of the furnace. Thus, the coke is burned, thereby producing pig iron and slag. In accordance with the progress in the pig iron manufacturing process of the blast furnace, at present, expensive coke is replaced with the pulverized coal by using a pulverized coal injecting apparatus 4 in which tuyere is formed to feed the pulverized coal. In the case of a blast furnace in which this pulverized coal is fed as described above, a large cavity which is called a race way (combustion area) 3 is formed on the front of the tuyere due to the high temperature air flow. FIG. 1(*b*) illustrates in detail the race way 3.

Most of the coke and the pulverized coal are burned in the race way (combustion area) to supply the heat which is required in reducing the ore. However, depending on cases, the unburnt pulverized coal passes through the coke layer within the blast furnace, to be partly discharged to the outside of the furnace, and to be partly accumulated within the coke layer in which the gas velocity is relatively slow. This accumulated unburnt pulverized coal remains within the inner region of the furnace to alter the gas flow. Further, it lowers the intra-furnace temperature, and increases the permeability resistance, with the result that the size of the race way is decreased. As the pulverized coal feeding amount is increased, the decrease of the combustion efficiency of the pulverized coal becomes very serious, with the result that the manufacturing cost of the pig iron is increased.

In order to solve this problem, in the general technique, pure oxygen is enriched, thereby improving the combustion efficiency of the pulverized coal. By carrying out the pure oxygen enrichment through the tuyere, the oxygen concentration in the hot air flow is increased so, as to promote the combustion of the pulverized coal. However, in this method, the flow amount of the hot blast is very large, and therefore, even if oxygen is enriched to a high degree, the actual oxygen concentration increases just by several percent, with the result that the final effect is meager. Further, the cost of newly building the oxygen producing facilities is very high, and therefore, there is a limit in carrying out the oxygen enrichment.

Meanwhile, in order to solve the above described problem, recently, efforts have been concentrated on modifying the structure of the pulverized coal injecting apparatus.

FIG. 2*a* illustrates one example of this. As shown in this drawing, a pulverized coal injecting apparatus 10 is of a coaxial type, and the pulverized coal is fed through an inner pipe 12, while pure oxygen is enriched in an outer pipe 11. Thus the oxygen concentration is raised to improve the combustion efficiency. In this method, the combustion efficiency is somewhat improved compared with the case of carrying out the hot blast oxygen enrichment. In this method, however, the external oxygen cannot intrude into the pulverized coal flow, but burns only in the outer regions.

FIG. 2*b* illustrates another effort of solving the above described problem. In this method, an oxygen flow swirler 23 is formed between the coaxial pipes, so as to form a vortex in the inner region of the pulverized coal flow. However, as has been widely recognized, the effect of installing the swirler depends on how suitable it is to the structure of the burner. In other words, if the spiral angle is too deep, the oxygen is directed to the outside of the pulverized coal flow rather than the inner region, with the result that the combustion efficiency is lowered. On the other hand, if these angle is too shallow, it is not different from the case of the general coaxial lance as shown in FIG. 2*a*.

As still another example of the efforts, there is a single piped expanded pulverized coal injecting apparatus in which the diameter of the single pipe is sufficiently expanded so as to cause a turbulent pulverized coal flow in the leading end of the feeding pipe. In this method, however, there is required a large scale improvement in the auxiliary facilities. Further, if an expanded pipe is installed within the tuyere, the cross sectional area of the tuyere is decreased, thereby impeding the introduction of the hot blast into the blast furnace so as to lower the productivity.

As still another attempt, there is an eccentric double-lance in which two single pipes are set to improve the combustion efficiency. However, if two pulverized coal injecting pipes are installed within a single tuyere, then the cross sectional area is decreased as described above, and therefore, not only are to the productivity and furnace condition stability, adversely effected but also management becomes troublesome since the number of the injecting pipes is doubled.

Besides, in still another attempt, the oxygen feeding angle is altered to forcibly mix the oxygen into the pulverized coal flow. In this case, however, although the combustion efficiency is improved, the flame width is expanded to cause damages in the tuyere. Further, the leading end of the pipe is slightly protruded to alter the feeding angle, and therefore, the protrusion is worn out due to the continuous collisions with the pulverized coal flow.

SUMMARY OF THE INVENTION

The present invention is intended to overcome the above described disadvantages of the conventional techniques.

Therefore it is an object of the present invention to provide a pulverized coal injecting apparatus in which the tuyere of the blast furnace or the like is not damaged, and yet the combustion efficiency of the pulverized coal is markedly improved.

In achieving the above object, the pulverized coal injecting apparatus according to the present invention includes: a cylindrical inner pipe for feeding a pulverized coal into a tuyere; a cylindrical outer pipe coaxially surrounding the inner pipe; a spiral swirler formed on a surface of the inner pipe; the pulverized coal being supplied through the inner pipe; and a combustible fluid being supplied through between the outer and inner pipes. The pulverized coal injecting apparatus further includes: a plurality of dimples formed on the surface of the leading end portion of the inner pipe, for reducing a fluid flow resistance to improve the mixing of the pulverized coal with the fluid.

In another aspect of the present invention, the pulverized coal injecting apparatus according to the present invention includes: a cylindrical inner pipe for feeding a pulverized coal into a tuyere; a cylindrical outer pipe coaxially surrounding the inner pipe; a spiral flow path formed on the surface of the inner pipe; a pulverized coal being fed through the inner pipe; and a combustible fluid being fed through between the inner and outer pipes. The pulverized coal injecting apparatus further includes: a plurality of dimples formed on a part of the surface of the leading end portion of the inner pipe; and W/D=0.5 to 4, where D indicates a depth of the dimples, and W indicates a width of the dimples.

BRIEF DESCRIPTION OF THE DRAWINGS

The above object and other advantages of the present invention will become more apparent by describing in detail the preferred embodiment of the present invention with reference to the attached drawings in which:

FIG. 7 illustrates a second embodiment of the pulverized coal injecting apparatus according to the present invention;

FIG. 8 illustrates various cross sectional shapes of the dimples according to the presint invention, in which:

FIGS. 8(*a*), 8(*b*) and 8(*c*) illustrate round cross-sectional shapes; and FIGS. 8(*d*) and 8(*e*) illustrate angular cross-sectional shapes;

DETAILED DESCRIPTION OF THE PREFERRED EMBODIMENTS

Figure 1A:
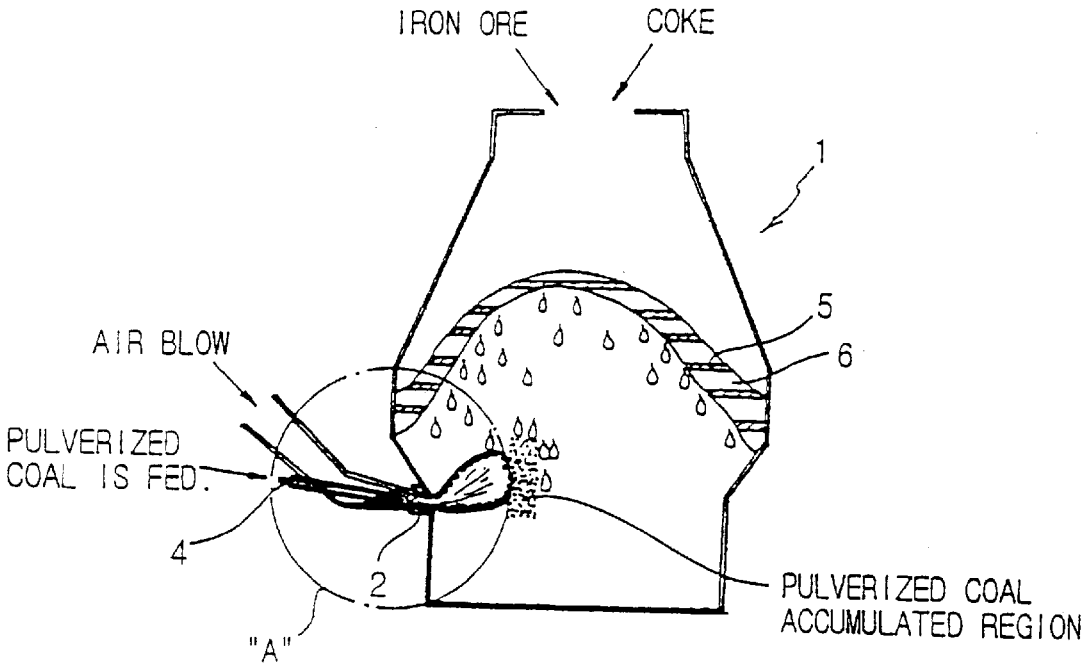
FIGS. 1*a* and 1*b* illustrate the operating status of the general blast furnace.
Figure 1B:
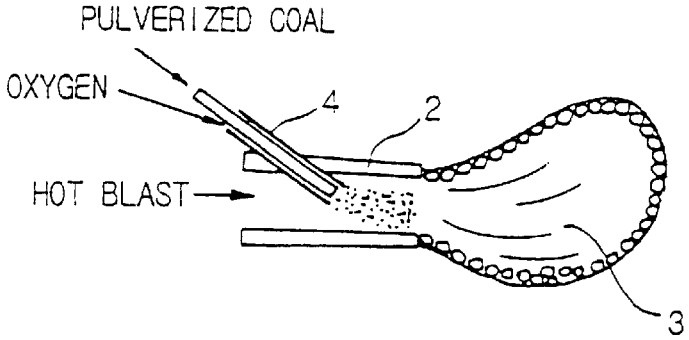
PRIOR ART FIG. 1(b)
Figure 2A:
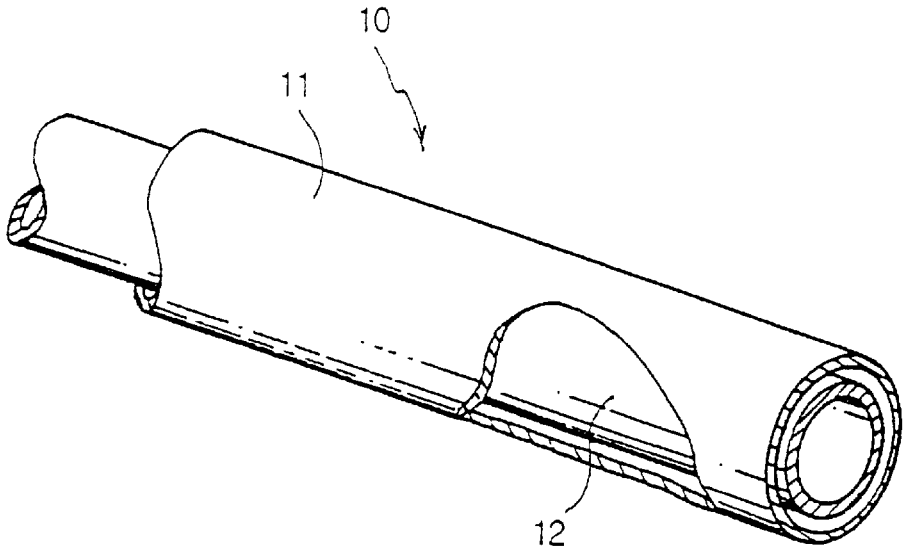
FIGS. 2*a* and 2*b* illustrate the conventional pulverized coal injecting apparatus.
Figure 2B:
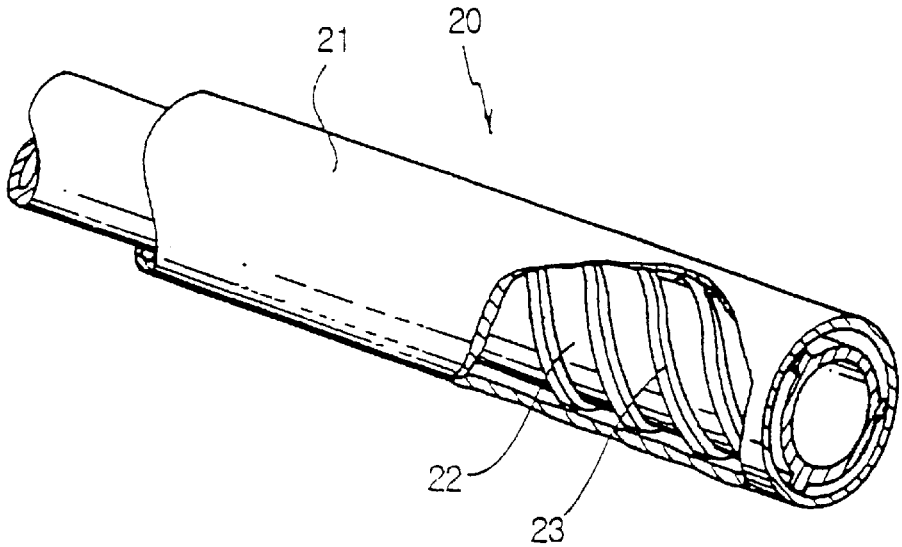
PRIOR ART FIG. 2(b)
Figure 3:
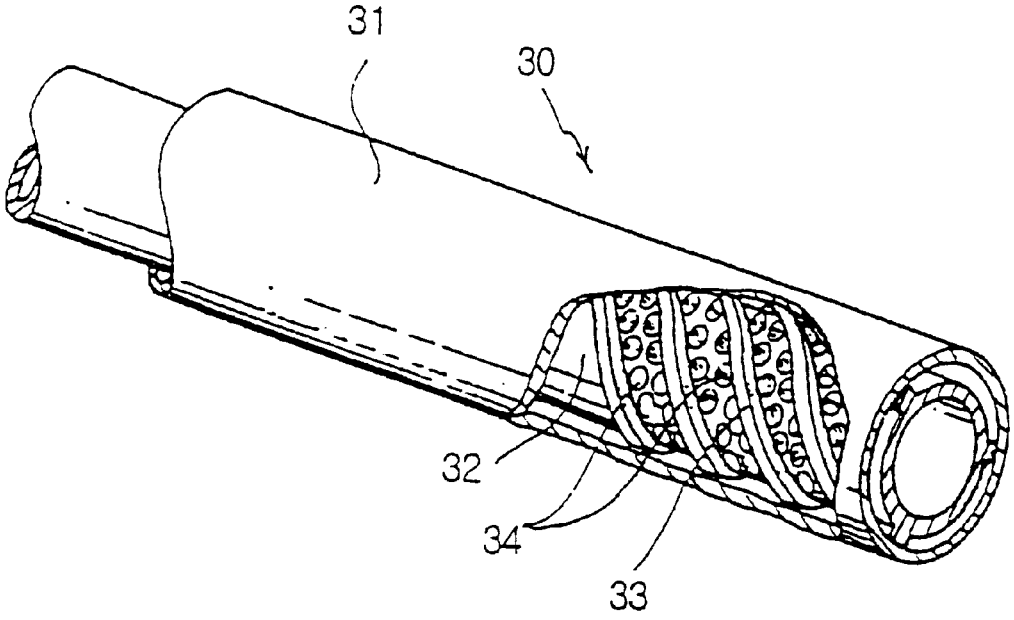
FIG. 3 illustrates the constitution of the pulverized coal injecting apparatus according to the present invention.

As shown in FIG. 3, a first embodiment of the pulverized coal injecting apparatus according to the present invention basically includes: a cylindrical inner pipe 32; a cylindrical outer pipe 31 coaxially surrounding the inner pipe for forming a coaxial pipe structure; and a spiral swirler 33 formed on the surface of the inner pipe 32.

Unlike the conventional pulverized coal injecting apparatuses, the pulverized coal injecting apparatus according to the present invention includes a plurality of semi-spherical dimples 34 formed on the surface of the inner pipe 32. The semi-spherical dimples should be preferably formed over a distance of 100 mm from the leading end of the inner pipe. In the case of a fluid flowing through between the two pipes, an introduction portion is required for ensuring a stable flow overcoming the agitations which have been caused at the mouth. In the case of a laminar flow, this value corresponds to a 0.05-multiple of the Reynold's number, but in the case of a turbulent flow, it is far shorter. In the case of the present invention, with a turbulent flow over the length of 100 mm, a fully developed fluid flow could be obtained. The cylindrical inner pipe can feed a liquid fuel or a gaseous fuel into a tuyere.

The semi-spherical dimples decrease the flow resistance of the combustible fluid which flows between the inner and outer pipes 32 and 31, thereby improving the mixing owing to the vortex which is generated at the leading end of the injecting apparatus. In the above, the combustible fluid may be usually oxygen.

In expressing the flow of the fluid, the turbulence degree of the fluid flow is expressed, and for this, the Reynold's number is used.

FORMULA 1

Reynold's number=pipe diameter×velocity×fluid density/fluid viscosity

At a Reynold's number of 2000 or less, the flow is of laminar type, and at 2000 or more, the flow is of turbulent type. In the case of the turbulent flow at more than 2000 of the Reynold's number, there is a segment where the flow pattern is drastically altered in accordance with the surface conditions of the pipe. Thus, in the present invention, a combustible fluid is supplied in the range of Reynold's number 2000 to 400,000.

In the case of the semi-spherical dimples of the present invention, at a Reynold's number of 40,000 to 400,000, the intra-pipe resistance is decreased to ½, the fluid flow becomes smooth, and the mixing of the fluid at the leading end of the pipe is promoted. The currently used oxygen enrichment amount is about 300 $Nm^3$/hr, and the Reynold's number for the oxygen flowing through between an outer pipe inside diameter of 41 mm and an inner pipe outside diameter of 34 mm is about 100,000. Accordingly, if the dimples are formed on the surface of the inner pipe, then the combustion efficiency is improved. Here, the semi-spherical dimples which are formed on the surface of the inner pipe should be preferably arranged in a zig zag form.

Now the present invention will be described based on actual experimental examples.

EXPERIMENTAL EXAMPLE 1

The conventional coaxial pulverized coal injecting apparatus with the spiral swirler formed thereon and the coaxial pulverized coal injecting apparatus with the dimples formed thereon were subjected to experiments to see the mixing efficiency between oxygen and pulverized coal. The experimented results are illustrated in FIG. 4.

Figure 4A:
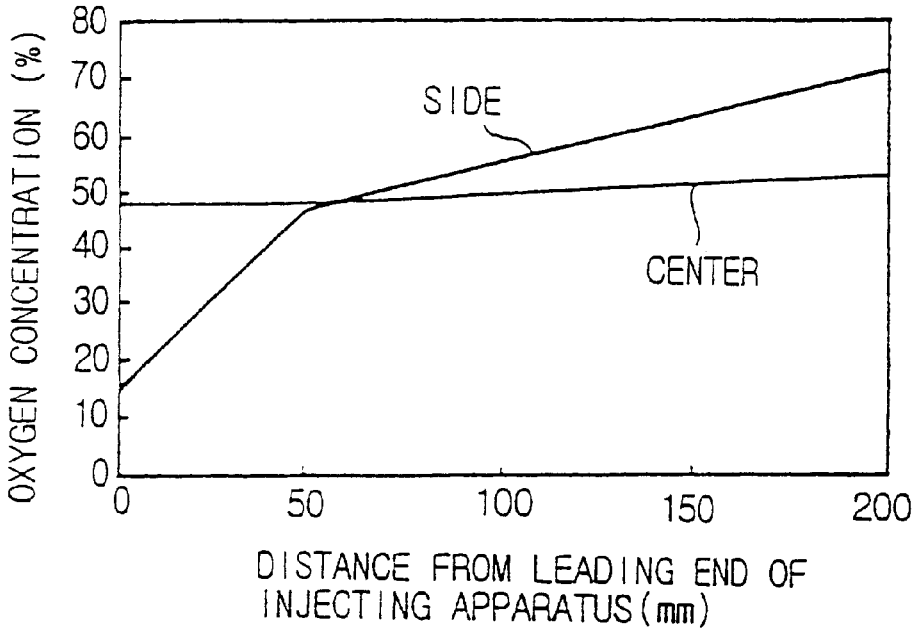
FIGS. 4*a* and 4*b* are graphical illustrations comparatively showing the oxygen concentration of the conventional apparatus and that of the apparatus of the present invention.

In the case of FIG. 4*a* in which only the conventional spiral swirler is adopted, the oxygen concentration in the inner region was 50%. Further, it was seen that, as the fluid advanced in the axial direction of the pipe, the oxygen was spread toward the peripheral regions, and that the mixing efficiency between the pulverized coal and the oxygen was lowered.

Figure 4B:
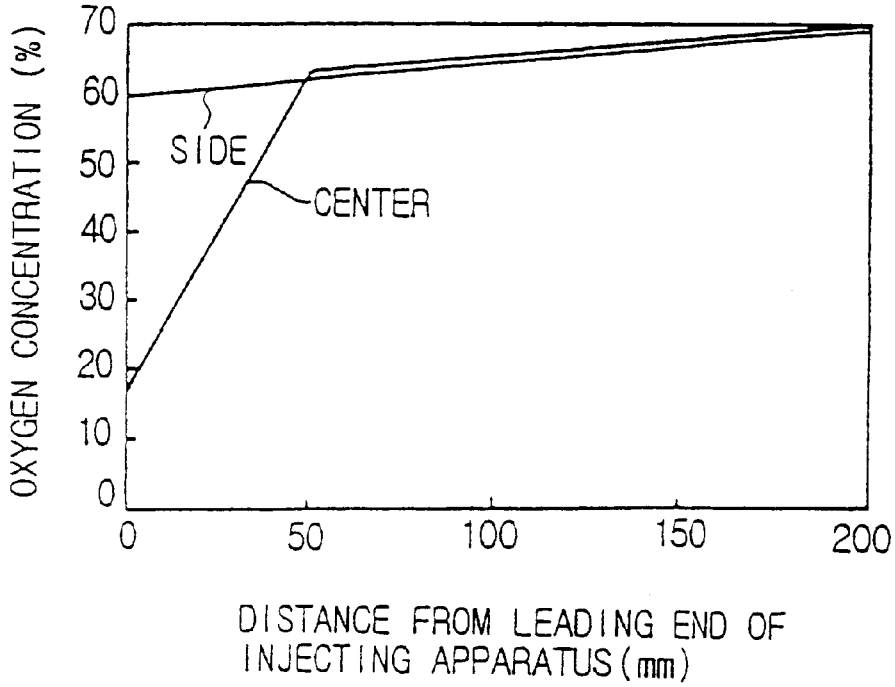

On the other hand, in the case of FIG. 4*b* in which the apparatus of the present invention was utilized, the oxygen concentration in the inner region was 60%. Further, it was seen that, as the fluid advanced in the axial direction of the pipe, the oxygen was not spread toward the peripheral regions. Therefore, the oxygen concentration at the center of the flow was gradually increased.

EXPERIMENTAL EXAMPLE 2

In order to see the combustion efficiencies of the two kinds of the coaxial pipes, the oxygen gas as an auxiliary combustion material, a nitrogen gas as a carrying gas, and a gaseous fuel as a fuel were used to carry out the experiment.

Figure 5A:
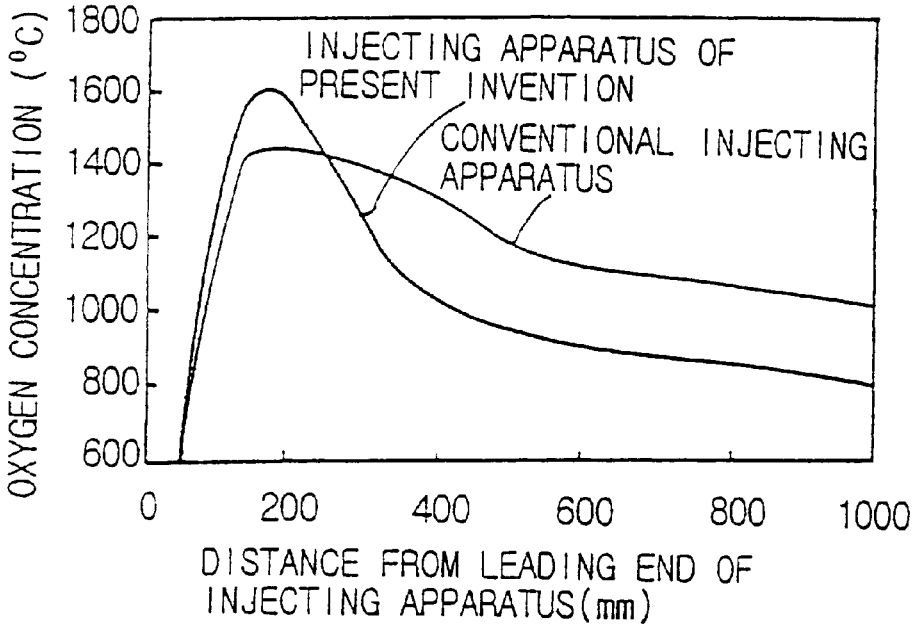
FIGS. 5*a* and 5*b* are graphical illustrations comparatively showing the combustion temperature of the conventional apparatus and that of the apparatus of the present invention.
Figure 5B:
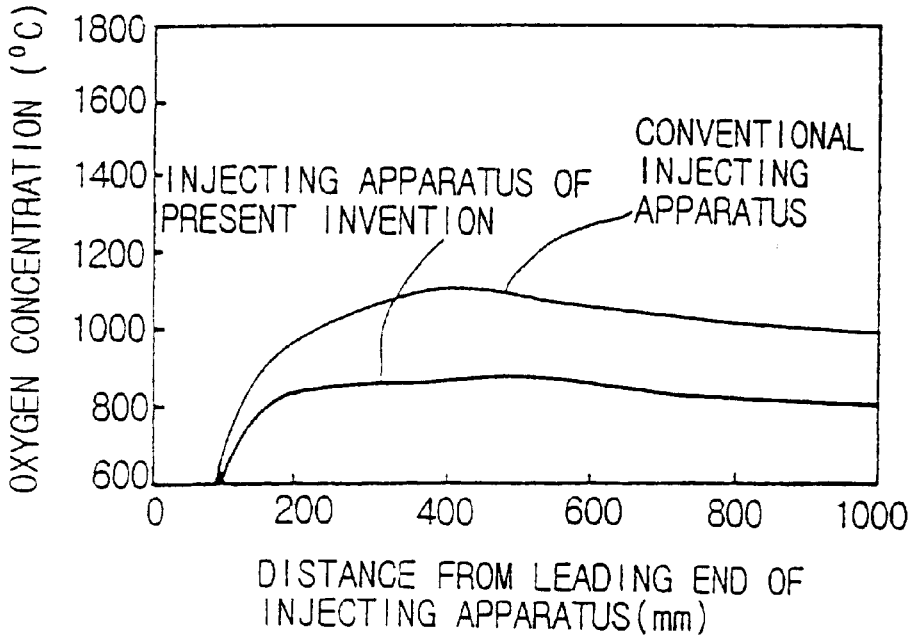

FIG. 5 illustrates the results of the experiments on the two kinds of the coaxial pipes. Of them, FIG. 5*a* illustrates the results of measuring the temperature at the center of the flame, and FIG. 5*b* illustrates the results of measuring the temperature at the peripheral region of the flame.

The results of measuring the temperature of the center of the flame are as shown in FIG. 5*a*. That is, in the case of the apparatus of the present invention, a combustion of almost 100% occurred in the first half portion, and therefore, the central temperature of the first half portion was higher by about 200–300° C. compared with the conventional case. In the last half portion, there was no fuel left to be burned, and therefore, the temperature was lowered in the last half portion.

Meanwhile, the temperature of the peripheral regions is illustrated in FIG. 5*b*. That is, in the case of the conventional apparatus, the flame temperature in the peripheral regions was lowered by about 200° C. This corresponds to the cold rolling experiment, and this owes to the fact that the oxygen is not spread to the peripheral regions, but is converged to the central regions.

EXPERIMENTAL EXAMPLE 3

When carrying out the blast furnace operation, in order to compare the actual combustion efficiencies in the race ways, a pulverized coal of 150 Kg/t-p and an oxygen enrichment of 10,000 $Nm^3$/hr were adopted in 34 pulverized coal injecting devices. Thus the highest temperatures in the race ways were measured, and the results are shown in FIG. 6.

Figure 6:
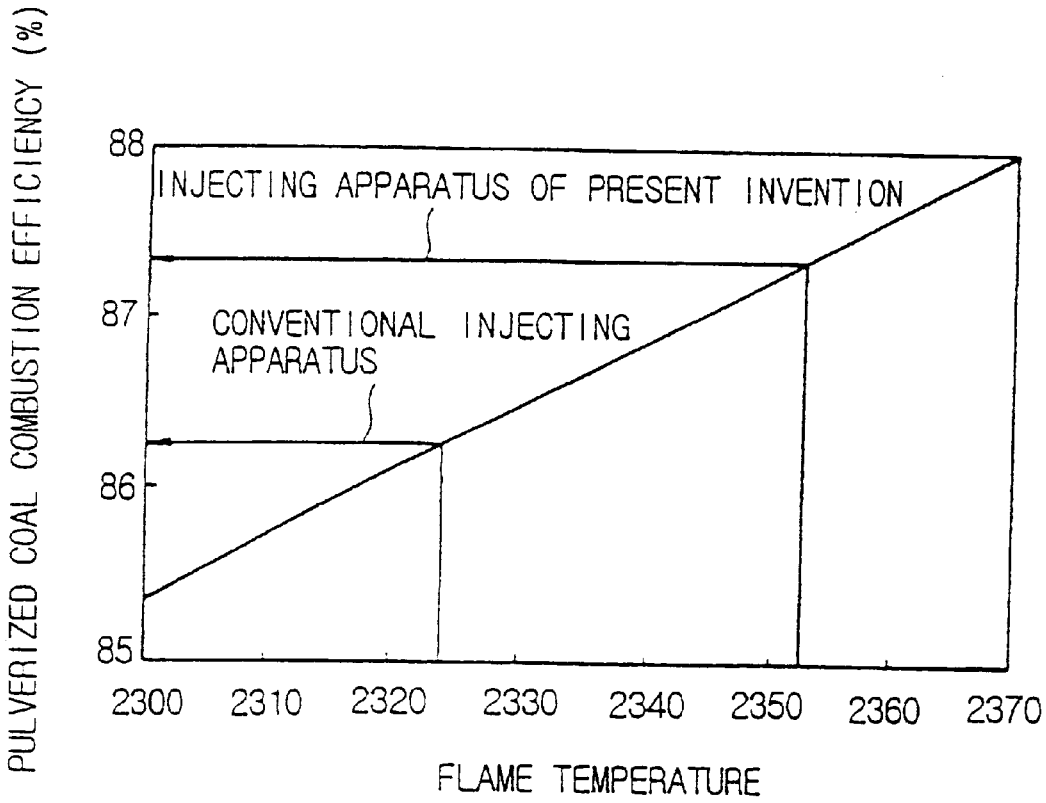
FIG. 6 is a graphical illustration comparatively showing the combustion efficiency in the race way of the conventional apparatus and that in the race way of the apparatus according to the present invention.

As shown in FIG. 6, in the apparatus of the present invention compared with the conventional apparatus, the combustion efficiency was increased by about 1–2%, and because of this, the fuel ratio was decreased by about 2 Kg/ton-pig.

FIG. 7 illustrates a second embodiment of the pulverized coal injecting apparatus according to the present invention.

In this second embodiment of the pulverized coal injecting apparatus of the present invention, a plurality of dimples 105 are formed on the surface of the leading end of an inner pipe 142 (having a thickness t). The depth of the dimples 105 is called D, and the width of the dimples 105 is called W. Under these assumptions, W/D is designed to be 0.5 to 4. In the case where the currently using oxygen enrichment is 20 to 400 $Nm^3$/hr, and where the oxygen passes through between an outer pipe 145 (having an inside diameter of 41 mm) and an inner pipe 142 (having an outside diameter of 31 mm), the Reynold's number becomes 60,000 to 200,000. Therefore, if the dimples 105 are formed on surface of the inner pipe 142, then there was improved the mixing between the fuel flowing through a pulverized coal flow path 150 of the inner pipe 142 and the fluid flowing through between the inner and outer pipes 142 and 145. However, different effects were generated depending on the shapes of the dimples. Therefore, by adopting the dimples of various shapes as mentioned below, the combustion efficiencies were obtained by experiments.

As illustrated in FIG. 8, the shapes of the dimples 105 were made different in accordance with the depth D of the dimples 105 and the width W of the dimples 105. The case where the diameter of the bottom of the dimple is different from the diameter of the top of the dimple, the case where the former was same as the latter, and the case where the former was larger than the latter, were distinguished. FIGS. 8*a*, 8*b* and 8*c* illustrate the cases where the cross sectional shape of the dimple is round, while FIGS. 8*d* and 8*e* illustrate the cases where the cross sectional shape is angular.

EXPERIMENTAL EXAMPLE 4

Figure 9A:
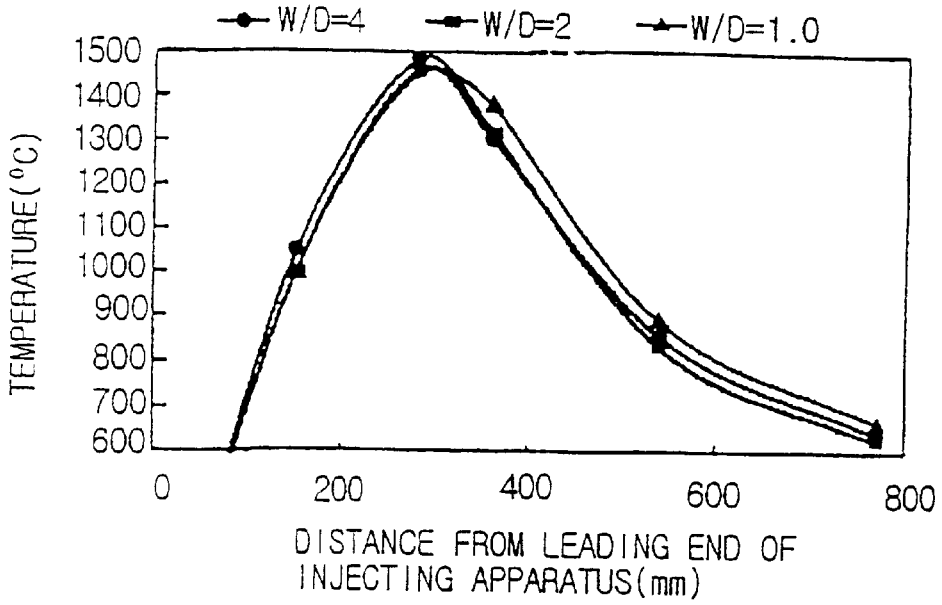
FIG. 9*a* is a graphical illustration comparatively showing the combustion states (when the oxygen is enriched between the inner and outer pipes of the lance) for the case where W/D is 4, is 2 and is 1, where D indicates the depth of the dimples, and W indicates the width of the dimples.

FIG. 9*a* is a graphical illustration comparatively showing the combustion states (when the oxygen is enriched between the inner and outer pipes of the lance) for the case where W/D is 4, is 2 and is 1, where D indicates the depth of the dimples, and W indicates the width of the dimples. According to these experiments, the results showed the case where W/D was 2. That is, when W/D was 2, to be superior the temperature at a first point from the leading end was very high. The temperature at a second point was also high, while the temperatures at third, fourth and fifth points (where the residual fuel was burned) were low. In view of this, the combustion efficiency was highest in the case where W/D was 2.

EXPERIMENTAL EXAMPLE 5

Figure 9B:
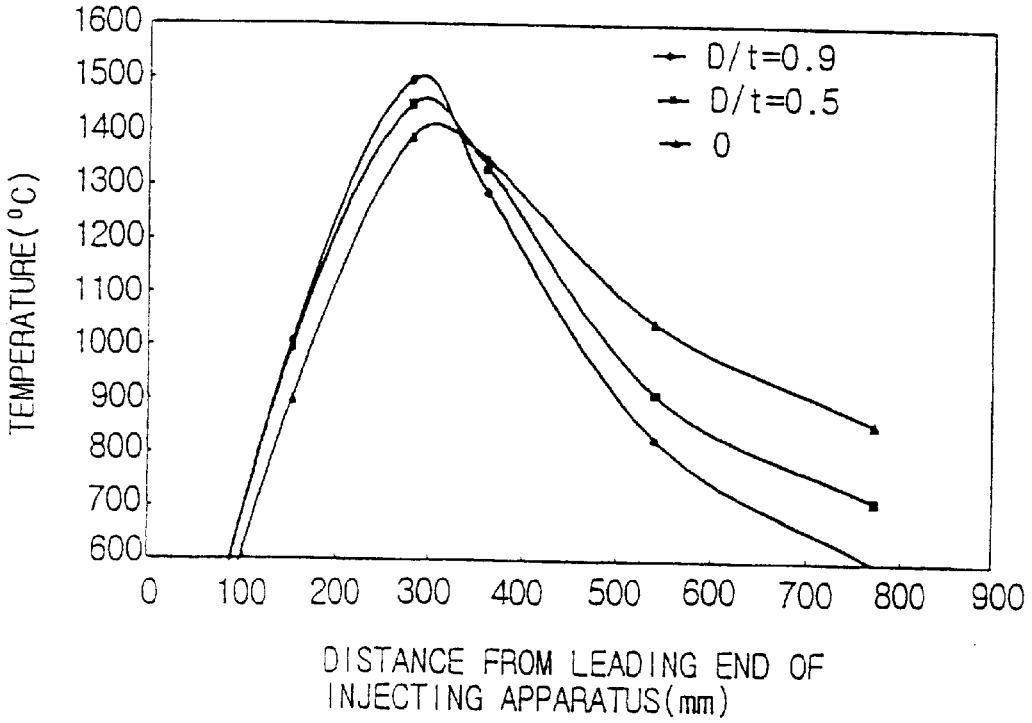
FIG. 9*b* is a graphical illustration comparatively showing the combustion states for the cases where the ratio D/t between the lance thickness t and the dimple depth D is 0.9, 0.5 and 0, when the oxygen enrichment is carried out between the outer and inner pipes.

FIG. 9*b* is a graphical illustration comparatively showing the combustion states for the cases where the ratio D/t between the lance thickness t and the dimple depth D was 0.9, 0.5 and 0, when the oxygen enrichment was carried out between the outer and inner pipes. The combustion efficiency was most superior in the case where D/t was 0.9.

EXPERIMENTAL EXAMPLE 6

Figure 9C:
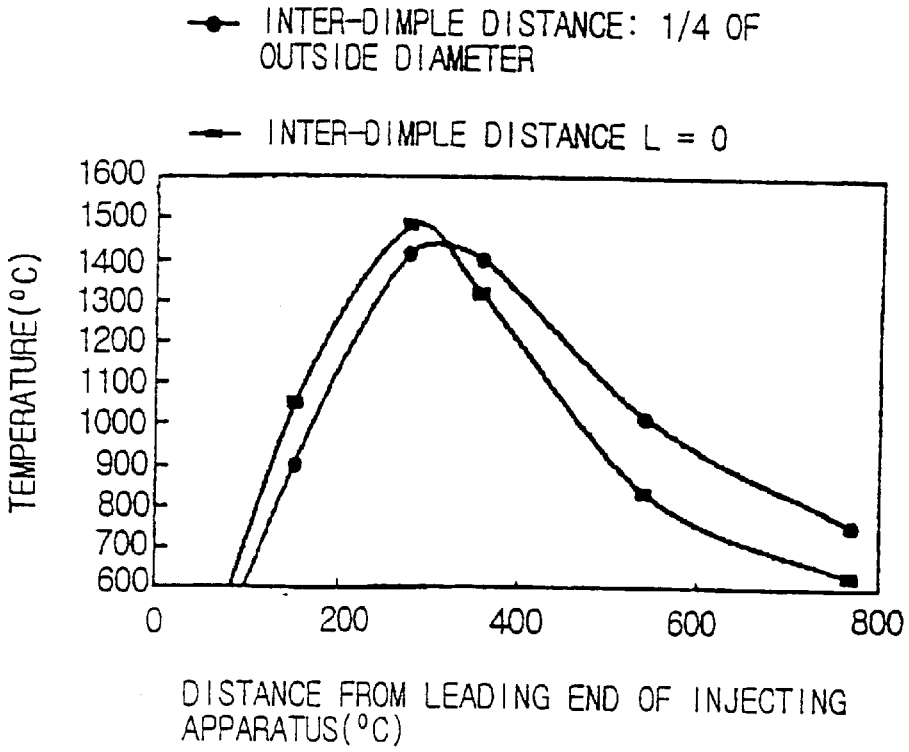
FIG. 9*c* is a graphical illustration comparatively showing the oxygen enriching methods for the case where W/D is 2, and where the distance L between the dimples is 0, and L is ¼ of the outside diameter of the pipe.

FIG. 9*c* is a graphical illustration comparatively showing the oxygen enriching methods for the case where W/D was 2, and where the distance L between the dimples was 0, and where L was ¼ of the outside diameter of the pipe. The experimental result showed to be as follows. That is, the case where the distance L between the dimples 105 was 0, that is, the case where the dimples 105 were arranged in a zig zag form, showed the highest combustion efficiency. This shows the number of the dimples 105. If the number of the dimples is large, the combustion efficiency was greatly improved. Under the same principle, if the number of the dimples 105 was large, then the initial and highest temperature were very high, while the temperature of the last half portion was low.

EXPERIMENTAL EXAMPLE 7

Figure 9D:
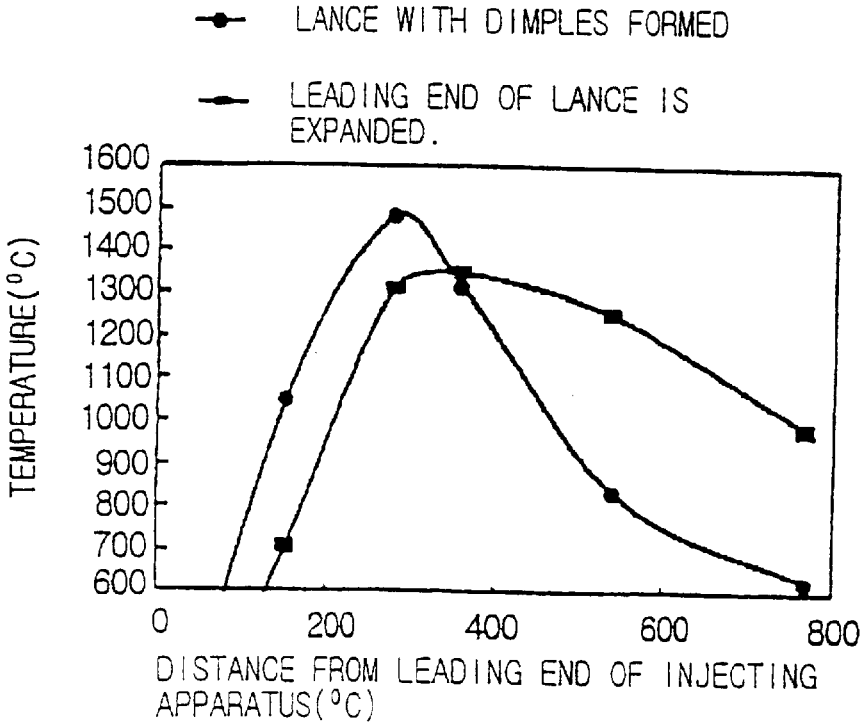
FIG. 9*d* is a graphical illustration comparatively showing the oxygen enriching methods for the case where the leading end of the coaxial pipes is expanded by 2 mm, and where dimples having a depth of 2 mm are formed.

FIG. 9*d* is a graphical illustration comparatively showing the oxygen enriching methods for the case where the leading end of the coaxial pipes was expanded by 2 mm, and where dimples having a depth of 2 mm were formed. The result showed that the combustion efficiency was greatly improved owing to the effect of the dimples 105. In the case of the conventional apparatus, the temperature in the last half portion was very high due to the combustion of the residual oxygen.

EXPERIMENTAL EXAMPLE 8

The combustion efficiency was almost the same in the different shapes of the dimples as shown in FIG. 8. FIG. 8*a* illustrates the cross sectional shape of the dimple 105, for the case where W/D was 4. FIG. 8*c* illustrates the cross sectional shape of the dimple 105, for the case where W/D was 0.5. All of these cases showed superior combustion efficiencies compared with the conventional apparatus.

Figure 10:
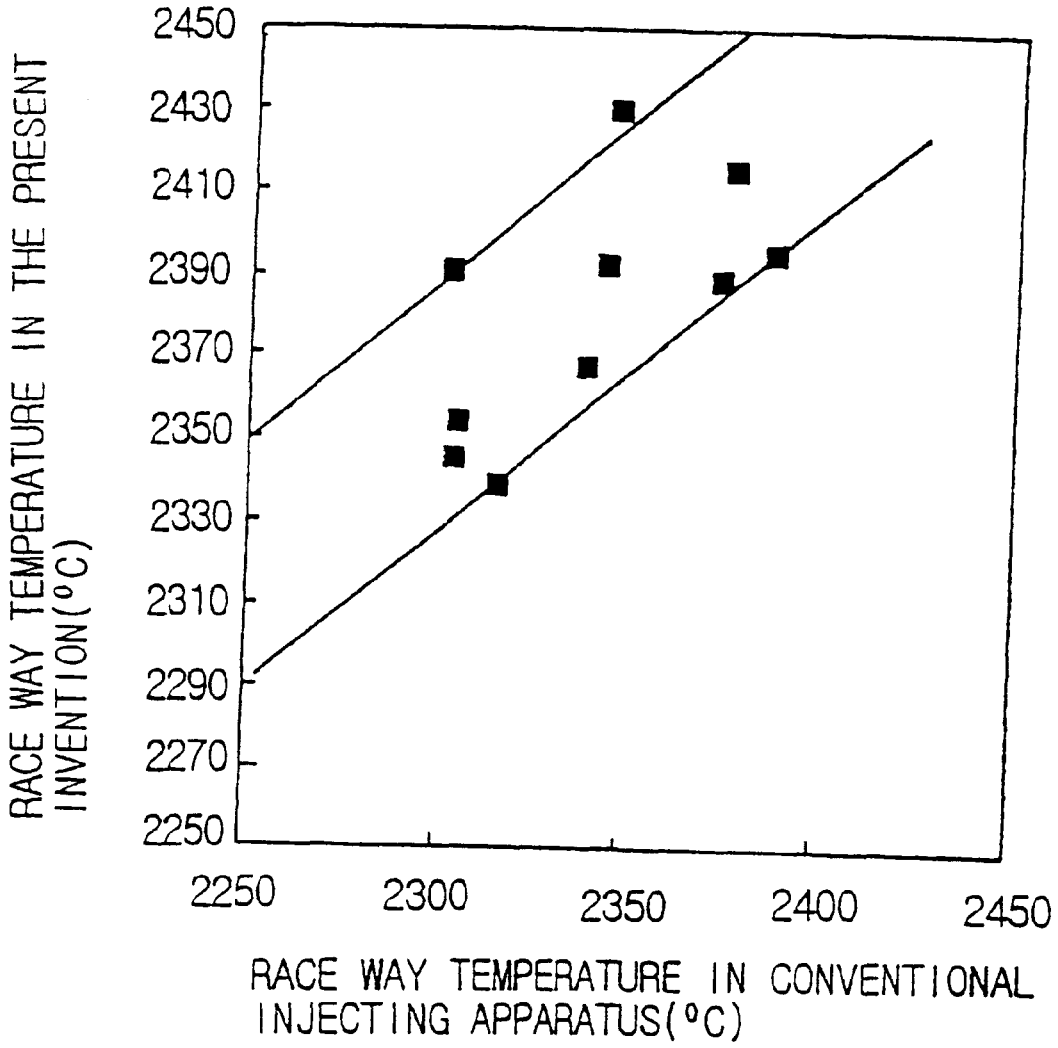
FIG. 10 is a graphical illustration comparatively showing the race ways for the case where W/D is 0.5 to 5.

FIG. 10 is a graphical illustration comparatively showing the race ways for the case where W/D of the dimple was 0.5 to 4 according to the present invention, and for the case of the conventional apparatus.

As shown in this drawing, the temperature was raised by more than 50° C. compared with the conventional case.

According to the present invention as described above, the fluid flow becomes efficient to improve the combustion efficiency for the pulverized coal, and therefore, the oxygen enrichment cost and the fuel cost can be saved.

And also, the dimples can be formed on the inner surface of inner pipe, in case of injecting a pulverized coal through between the outer and inner pipes, and injecting the combustible fluid through the inner pipe.

Further, according to the present invention, since the fuel cost is curtailed through the improvement of the combustion efficiency, and since the unburnt coal fines can be prevented from being accumulated, the stability of the furnace operating conditions can be ensured.

What is claimed is:

1. A pulverized coal injecting apparatus comprising:

a cylindrical inner pipe for feeding a pulverized coal into a tuyere;

a cylindrical outer pipe coaxially surrounding said inner pipe;

a spiral swirler formed on a surface of said inner pipe;

the pulverized coal being supplied through said inner pipe; and a combustible fluid being supplied through between said outer and inner pipes, the pulverized coal injecting apparatus further comprising:

a plurality of dimples formed on a surface of a leading end portion of said inner pipe, for reducing a fluid flow resistance to improve a mixing of the pulverized coal with a fluid.

2. The pulverized coal injecting apparatus as claimed in claim 1, wherein said dimples are formed on a portion within 100 mm from a leading end of said inner pipe.

3. The pulverized coal injecting apparatus as claimed in claim 1, wherein said dimples are formed in a zig zag form.

4. The pulverized coal injecting apparatus as claimed in claim 1, wherein said dimples have a semi-spherical cross section.

5. The pulverized coal injecting apparatus as claimed in claim 1, said dimples are formed on the inner surface of inner pipe, in case of injecting a pulverized coal through between said outer and inner pipes, and injecting said combustible fluid through said inner pipe.

6. A pulverized coal injecting apparatus comprising:

a cylindrical inner pipe for feeding a pulverized coal into a tuyere;

a cylindrical outer pipe coaxially surrounding said inner pipe;

a spiral flow path formed on a surface of said inner pipe;

a pulverized coal being fed through said inner pipe; and a combustible fluid being fed through between said inner and outer pipes, the pulverized coal injecting apparatus further comprising:

a plurality of dimples formed on a part of a surface of a leading end portion of said inner pipe, W/D being 0.5 to 4, where D indicates a depth of said dimples, and W indicates a width of said dimples.

7. The pulverized coal injecting apparatus as claimed in claim 6, wherein W/D is 2.

8. The pulverized coal injecting apparatus as claimed in claim 6, wherein a distance L between said dimples is 0.

9. The pulverized coal injecting apparatus as claimed in claim 6, wherein said dimples have an angular cross-sectional shape.

10. A pulverized coal injecting apparatus comprising:

a cylindrical inner pipe for feeding a pulverized coal into a tuyere;

a cylindrical outer pipe coaxially surrounding said inner pipe;

a spiral flow path formed on a surface of said inner pipe;

a pulverized coal being fed through said inner pipe; and a combustible fluid being fed through between said inner and outer pipes, the pulverized coal injecting apparatus further comprising:

a plurality of dimples formed on a part of a surface of a leading end portion of said inner pipe, said dimples having a depth as large as a thickness of said inner pipe permits.

11. The pulverized coal injecting apparatus as claimed in claim 2, wherein said dimples have a semi-spherical cross section.

12. The pulverized coal injecting apparatus as claimed in claim 3, wherein said dimples have a semi-spherical cross section.

13. The pulverized coal injecting apparatus as claimed in claim 7, wherein said dimples have an angular cross-sectional shape.

14. The pulverized coal injecting apparatus as claimed in claim 8, wherein said dimples have an angular cross-sectional shape.

* * * * *

UNITED STATES PATENT AND TRADEMARK OFFICE

CERTIFICATE OF CORRECTION

PATENT NO. : 6,319,458 B1
DATED : November 20, 2001
INVENTOR(S) : Jin Kyung Jung et al.

It is certified that error appears in the above-identified patent and that said Letters Patent is hereby corrected as shown below:

Title page,
Item [22] PCT Filed: "Sep. 8, 1999" should read -- Aug. 9, 1999 --.

Column 1,
Line 5, "Sep. 8, 1999" should read -- Aug. 9, 1999 --.

Column 2,
Line 19, "if these angle" should read -- if the angle --.
Line 21, "the efforts" should read -- these efforts --.
Line 36, "are to the productivity" should read -- are productivity --.
Line 36, delete comma (,) after "stability" and insert comma (,) after "effected" on column 2 Line 37.

Column 3,
Line 38, "presint invention" should read -- present invention --.

Column 6,
Line 2, "improved the mixing" should read -- improved mixing --.
Line 29, "W/D was 2." should read -- W/D was 2 to be superior. --.
Line 29, after "when W/D was 2," delete "to be superior".

Signed and Sealed this

Fourth Day of June, 2002

*Attest:*

*Attesting Officer*

JAMES E. ROGAN
*Director of the United States Patent and Trademark Office*